US009624812B2

(12) United States Patent
Hayama

(10) Patent No.: US 9,624,812 B2
(45) Date of Patent: Apr. 18, 2017

(54) EXHAUST MUFFLER

(71) Applicant: HONDA MOTOR CO., LTD., Tokyo (JP)

(72) Inventor: Yoshitaka Hayama, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/002,779

(22) Filed: Jan. 21, 2016

(65) Prior Publication Data

US 2016/0245146 A1 Aug. 25, 2016

(30) Foreign Application Priority Data

Feb. 23, 2015 (JP) ..... 2015-032510

(51) Int. Cl.

| | |
|---|---|
| ***F01N 1/02*** | (2006.01) |
| ***F01N 13/00*** | (2010.01) |
| ***F01N 13/18*** | (2010.01) |
| ***F01N 1/08*** | (2006.01) |

(52) U.S. Cl.

CPC ..... *F01N 13/007* (2013.01); *F01N 1/084* (2013.01); *F01N 1/089* (2013.01); *F01N 13/1838* (2013.01); *F01N 2470/04* (2013.01); *F01N 2470/10* (2013.01); *F01N 2470/24* (2013.01); *F01N 2490/06* (2013.01); *F01N 2590/04* (2013.01)

(58) Field of Classification Search

CPC ..... F01N 13/007; F01N 13/089
USPC ..... 181/228, 227
See application file for complete search history.

(56) References Cited

U.S. PATENT DOCUMENTS

| | | | | |
|---|---|---|---|---|
| 7,464,789 | B2 * | 12/2008 | Yamamoto | F01N 1/089 181/212 |
| 7,506,722 | B2 * | 3/2009 | Emler | F01N 1/003 181/212 |
| 7,610,993 | B2 * | 11/2009 | Sullivan | F01N 1/02 181/212 |
| 7,673,720 | B2 * | 3/2010 | Meneely | F01N 1/02 181/212 |
| 7,694,778 | B2 * | 4/2010 | Toyoshima | F01N 1/084 181/212 |

(Continued)

FOREIGN PATENT DOCUMENTS

JP 2006-207548 A 8/2006

*Primary Examiner* — Forrest M Phillips
(74) *Attorney, Agent, or Firm* — Birch, Stewart, Kolasch & Birch, LLP

(57) ABSTRACT

In an exhaust muffler using a double communicating tube as a communicating tube between expansion chambers, the exhaust muffler controls exhaust gas so as not to flow directly between intake and exhaust ports of an inner communicating tube and an outer communicating tube to thereby utilize the volume of the expansion chamber sufficiently. On one end side of the double communicating tube facing into a second expansion chamber, a distal end opening of the inner communicating tube functions as an intake port of an inside passage. A closing member for closing an end in the axial direction of an annular passage is provided in or in the vicinity of a distal end opening of the outer communicating tube. An exhaust port for opening the annular passage outwardly in the radial direction is provided between the closing member of the outer communicating tube and a first partition wall.

23 Claims, 7 Drawing Sheets

(56) References Cited

U.S. PATENT DOCUMENTS

| | | | | |
|---|---|---|---|---|
| 8,302,732 | B2 * | 11/2012 | Gorke | F01N 1/084 181/212 |
| 2001/0018995 | A1 * | 9/2001 | Uegane | B60K 13/04 181/275 |
| 2012/0273302 | A1 * | 11/2012 | Takagaki | F01N 1/02 181/228 |

* cited by examiner

EXHAUST MUFFLER

CROSS-REFERENCE TO RELATED APPLICATIONS

The present application claims priority under 35 USC 119 to Japanese Patent Application No. 2015-032510 filed Feb. 23, 2015 the entire contents of which are hereby incorporated by reference.

BACKGROUND OF THE INVENTION

1. Field of the Invention

The present invention relates to an exhaust muffler.

2. Description of Background Art

An exhaust muffler is known wherein a partition wall is provided between expansion chambers with a communicating tube passing through the partition wall so as to provide communication between the expansion chambers. See, for example, Japanese Patent Application Laid-Open Publication No. 2006-207548. The communicating tube is a double tube formed of an outer communicating tube and an inner communicating tube. An inside passage within the inner communicating passage and an annular passage between the inner communicating tube and the outer communicating tube are formed as exhaust passages through which exhaust gases flow in opposite directions to each other. With this construction, in comparison with the case where a plurality of communicating tubes are arranged spaced apart from each other, an arrangement space for the plurality of communicating tubes (exhaust passages) is suppressed.

In the above mentioned exhaust muffler, an end portion of the inner communicating tube located in one end portion of the double communicating tube facing into one of the expansion chambers extends beyond a distal end opening of the outer communicating tube with both of distal end openings of the inner communicating tube and the outer communicating tube being located close to each other. The distal end opening of the inner communicating tube functions as an intake and exhaust port (an exhaust port in Japanese Patent Application Laid-Open Publication No. 2006-207548) of the inside passage, and the distal end opening of the outer communicating tube functions as an intake and exhaust port (an exhaust port in Japanese Patent Application Laid-Open Publication No. 2006-207548) of the annular passage. More specifically, an outlet of the outer communicating tube and an inlet of the inner communicating tube are directed in the same direction, and the inlet of the inner communicating tube is located in the exhaust direction of the outlet of the outer communicating tube, so that the exhaust gas flowing out of the outlet of the outer communicating tube easily enters the inlet of the inner communicating tube before it is expanded enough within the expansion chamber. Therefore, there is a possibility that the volume of the expansion chamber is not sufficiently utilized.

SUMMARY AND OBJECTS OF THE INVENTION

The present invention has been made in consideration of the above described circumstances, and an objective of an embodiment of the present invention is to provide an exhaust muffler having a double communicating tube as a communicating tube providing communication between expansion chambers and which controls the exhaust gas so as not to flow directly between intake and exhaust ports of an inner communicating tube and an outer communicating tube to thereby make it possible to sufficiently utilize the volume of the expansion chamber.

In order to achieve the above described object, according to an embodiment of the present invention, there is provided an exhaust muffler (10) comprising a cylindrical body (11), a partition wall (26) partitioning an interior of the cylindrical body (11) into a plurality of expansion chambers (31, 32), and a communicating tube (40) passing through the partition wall (26), wherein the communicating tube (40) is in the form of a double communicating tube (40) consisting of an outer communicating tube (41) and an inner communicating tube (42), and an inside passage (44) within the inner communicating passage (42) and an annular passage (43) between the inner communicating tube (42) and the outer communicating tube (41) function as exhaust passages through which exhaust gases flow in opposite directions to each other, wherein on one end side of the double communicating tube (40) facing into one (32) of the expansion chambers (31, 32), a distal end opening (42*c*) of the inner communicating tube (42) functions as an intake and exhaust port (48) of the inside passage (44), and wherein a closing portion (45) for closing an end in the axial direction of the annular passage (43) is provided in or in the vicinity of a distal end opening (41*d*) of the outer communicating tube (41). An outer circumferential intake and exhaust port (47) for opening the annular passage (43) outwardly in a radial direction is provided between the closing portion (45) of the outer communicating tube (41) and the partition wall (26).

According to an embodiment of the present invention, on the one end side of the double communicating tube (40), the distal end opening (42*c*) of the inner communicating tube (42) functions as an intake port (48), and the outer circumferential intake and exhaust port (47) functions as an exhaust port (47).

According to an embodiment of the present invention, the closing portion (45) is provided with a closing member (45) of a plate shape which intersects with an axial direction of the double communicating tube (40), and the closing member (45) is arranged closer to the distal end opening (41*d*) of the outer communicating tube (41) than the partition wall (26).

According to an embodiment of the present invention, the outer circumferential intake and exhaust port (47) is arranged to be offset toward the partition wall (26) between the closing portion (45) and the partition wall (26).

According to an embodiment of the present invention, on the other end side of the double communicating tube (40) facing into the other expansion chamber (31) partitioned from the one expansion chamber (32) by the partition wall (26), an end portion of the outer communicating tube (41) is supported on an opposed wall (27) located on the opposite side of the other expansion chamber (31) from the partition wall (26).

According to an embodiment of the present invention, a second closing portion (27*a*) which closes the distal end opening (41*c*) of the outer communicating tube (41) located on the opposed wall (27) side is formed in the opposed wall (27), and a second outer circumferential intake and exhaust port (46) which opens the annular passage (43) outwardly in the radial direction is provided in the end portion of the outer communicating tube (41) located on the opposed wall (27) side.

According to an embodiment of the present invention, an end portion of the inner communicating tube (42) located on the opposed wall (27) side is supported on the opposed wall (27), and an end of the inner communicating tube (42)

located on the partition wall (26) side is supported through the closing portion (45) on the outer communicating tube (41).

According to an embodiment of the present invention, another tube (35) which passes through the partition wall (26) is arranged below the double communicating tube (40), wherein the double communicating tube (40) has the inner communicating tube (42) of a circular cross section and the outer communicating tube (41) of a non-circular cross section, and the outer communicating tube (41) has a cross sectional shape of which a height dimension (H) in a vertical direction is smaller than a width dimension (W) in a horizontal direction.

According to an embodiment of the present invention, since, on one end side of the double communicating tube facing into one of the expansion chambers, the intake and exhaust port of the inner communicating tube is directed toward the axial direction, and the outer circumferential intake and exhaust port of the outer communicating tube is directed outwardly in the radial direction, the exhaust gas flowing out of the intake and exhaust port of one of the outer communicating tube and the inner communicating tube can be restrained from flowing directly into the intake and exhaust port of the other tube, in comparison with the case where the outer circumferential intake and exhaust port of the outer communicating tube is directed toward the axial direction similar to the intake and exhaust port of the inner communicating tube, whereby it can be expanded sufficiently within the expansion chamber. More specifically, the volume of the expansion chamber is sufficiently utilized whereby to be able to effectively perform noise reduction.

According to an embodiment of the present invention, since the exhaust gas discharged radially outwardly from the exhaust port of the outer communicating tube flows in such a way as to make a detour around the intake port of the inner communicating tube so as to be expanded within the expansion chamber, the exhaust gas flowing out of the outer communicating tube can be restrained from flowing directly into the inner communicating tube so as to be expanded sufficiently within the expansion chamber, so that the volume of the expansion chamber is sufficiently utilized whereby to be able to effectively perform noise reduction.

According to an embodiment of the present invention, in comparison with the case where the closing member terminating the annular passage is located in the vicinity of the partition wall, the length of the outer communicating tube is effectively utilized so that the length of the annular passage can be ensured and a range for providing the intake and exhaust port of the outer communicating tube can be ensured.

According to an embodiment of the present invention, since the outer intake and exhaust port and the distal end opening of the inner communicating tube are spaced apart from each other as far as possible, the exhaust gas flowing out of one of the intake and exhaust ports of the outer communicating tube and the inner communicating tube can be more effectively restrained from flowing directly into the other intake and exhaust port.

According to an embodiment of the present invention, the number of component parts is reduced and the outer communicating tube can be supported at both ends. Therefore, the support of the outer communicating tube can be stabilized as compared with cantilever support of the outer communicating tube, and the positioning and assembly of the outer communicating tube can be easily performed. In addition, the outer communicating tube can be extended long whereby to heighten a noise reduction effect.

According to an embodiment of the present invention, the other end side of the outer communicating tube is closed while being supported, and the exhaust gas flows in such away as to spread within the other expansion chamber. Therefore, the volume of the other expansion chamber also is utilized sufficiently, so that the noise reduction can be effectively performed.

According to an embodiment of the present invention, the number of component parts is reduced and the inner communicating tube can be supported at both ends. Therefore, the support and assembly of the inner communicating tube can be stabilized as compared with cantilever support, and the inner communicating tube can be extended long whereby to heighten the noise reduction effect.

According to an embodiment of the present invention, the double communicating tube and another tube are vertically arranged side by side, so that the width in the horizontal direction of the exhaust muffler can be reduced and the height in the vertical direction of the exhaust muffler can be reduced as much as possible. In addition, although the thickness in the radial direction of the annular passage varies in accordance with the positions in the circumferential direction due to the inner communicating tube of circular cross section and the outer communicating tube of non-circular cross section, a passage area can be ensured while reducing the height of the exhaust muffler as much as possible by reducing the thicknesses of both side parts in the height direction of the annular passage and increasing the thicknesses of both side parts in the width direction thereof.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4(*b*) is a view as seen in the direction of an arrow B of FIG. 4(*a*);

DETAILED DESCRIPTION OF THE PREFERRED EMBODIMENTS

An embodiment of the present invention will be described hereunder with reference to accompanying drawings.

In the following description, the orientation such as "front," "rear," "left," "right" or the like shall be identical with an orientation of a vehicle (two-wheeled motorcycle) to be referred to below unless otherwise specified. In addition, an arrow FR indicates a forward direction of the vehicle and an arrow UP indicating an upward direction of the vehicle.

Figure 1:
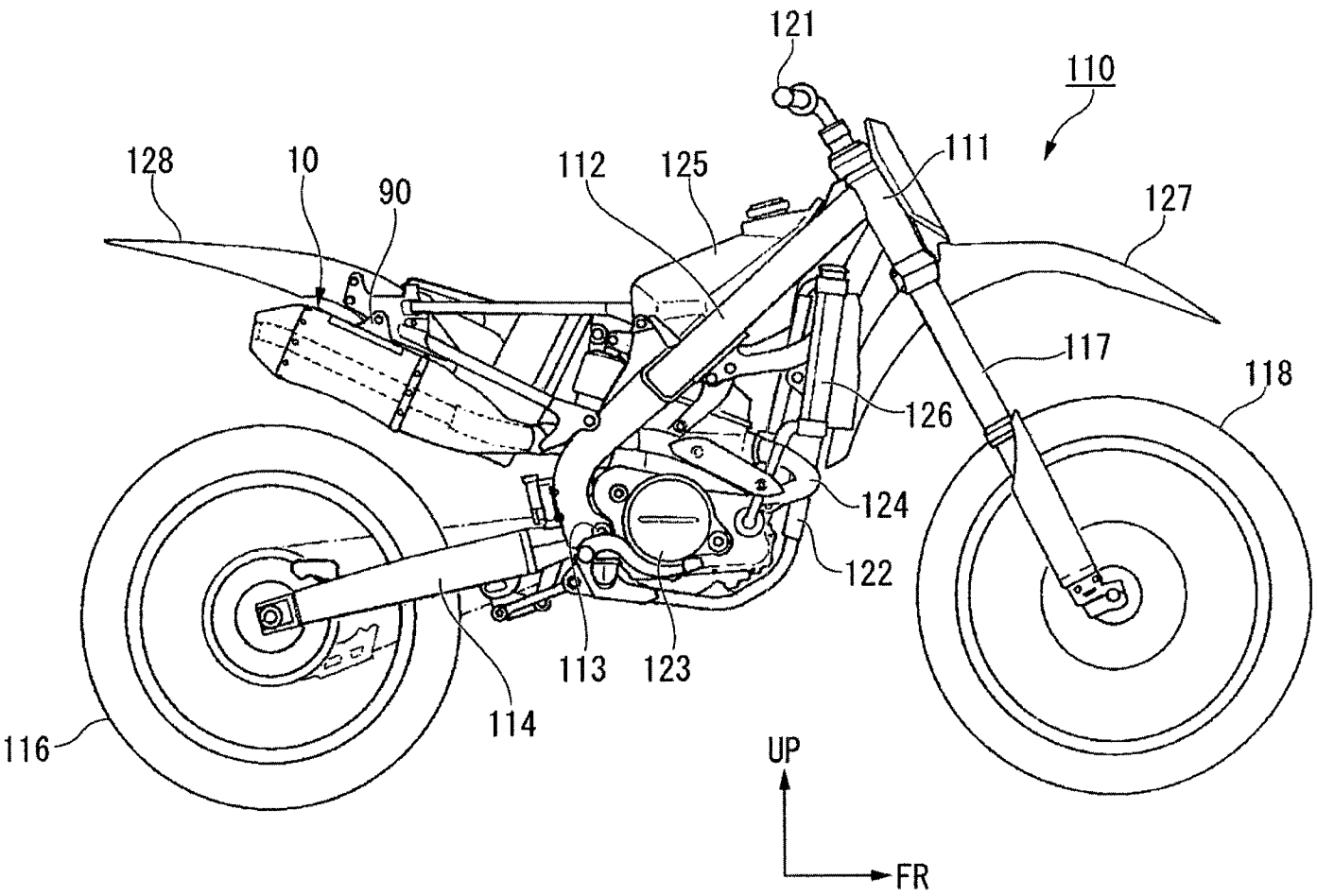
FIG. 1 is a right side view of a two-wheeled motorcycle in accordance with an embodiment of the present invention.

Referring to FIG. 1, a two-wheeled motorcycle 110 includes a pair of left and right main frames 112 extending from a head pipe 111 obliquely downwardly to the rear of the vehicle with a swing arm 114 extending from a rear part of the main frames 112 through a pivot shaft 113 to the rear of the vehicle. A rear wheel 116 is rotatably mounted on a rear part of the swing arm 114. A front fork 117 is mounted on the head pipe 111 in a rotatable (steerable) manner with a front wheel 118 rotatably mounted on a lower part of the front fork 117. A handle is mounted on an upper end of the front fork 117 for steering the front wheel 118. A down tube 122 extends downwardly from a neighboring part of the head pipe 111 and then rearwardly of the vehicle so as to be connected to a lower end of the rear part of the mainframe 112. An internal combustion engine 123 is arranged between the down tube 122 and the main frame 112 located above the down tube 122 with an exhaust pipe 124 extending forwardly of the vehicle from the internal combustion engine 123, then turning rearwardly so as to pass through the right side in the vehicle width direction of the internal combustion engine 123 and passes through between the pair of main frames 112 so as to extend to the rear of the vehicle. An exhaust muffler 10 is connected to a rear end of the exhaust pipe 124.

The internal combustion engine 123 is a water-cooled four-stroke cycle gasoline engine. A fuel tank 125 for the internal combustion engine 123 is supported on the main frames 112 in a rearward position of the head pipe 111. A radiator 126 for the internal combustion engine 123 is arranged along the down tube 122.

The motorcycle 110 is an off road vehicle which has a large upward and downward stroke amount of the wheel, so that a front fender 127 is located in a sufficiently higher position than the front wheel 118 and a rear fender 128 is located in a sufficiently higher position than the rear wheel 116.

Details of the exhaust muffler 10 will be described with reference to FIGS. 2 to 7. An arrow N in the drawing indicates the flow of the exhaust gas in the exhaust muffler 10.

The exhaust muffler 10 is connected to the rear end of the exhaust pipe 124 which discharges the exhaust gas from the internal combustion engine 123 toward the rear of the vehicle (see FIG. 1). The exhaust muffler 10 is formed in the shape of a cylinder which is inclined rearwardly upwardly with respect to the horizontal direction and extends linearly. An arrow FR' in the drawing indicates a forward direction in the axial direction of the cylinder of the exhaust muffler 10 (the axial direction of the muffler), and an arrow UP' indicates an upward direction lying at right angles to the axial direction of the muffler.

Figure 2:
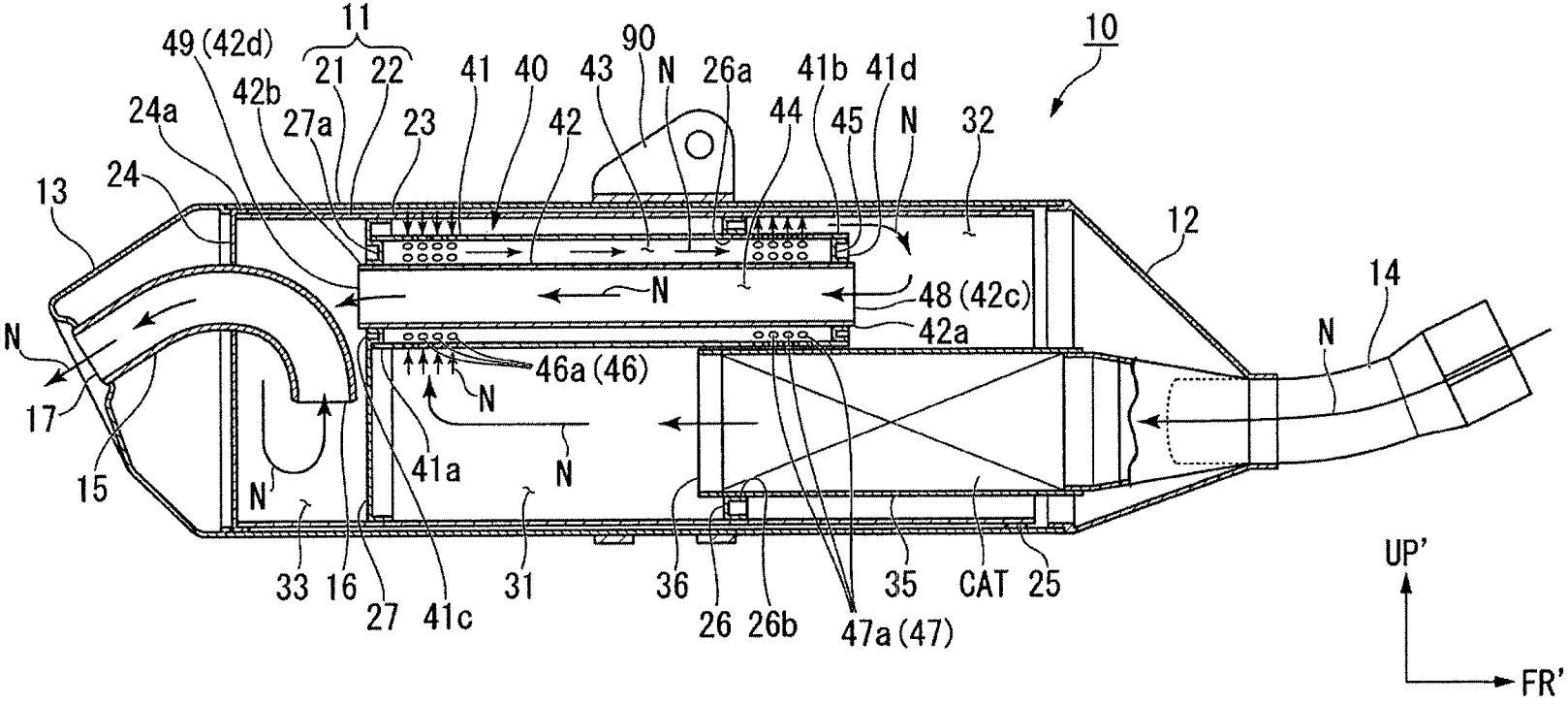
FIG. 2 is a vertical cross sectional view of an exhaust muffler of the above motorcycle taken in the axial direction thereof.
Figure 3:
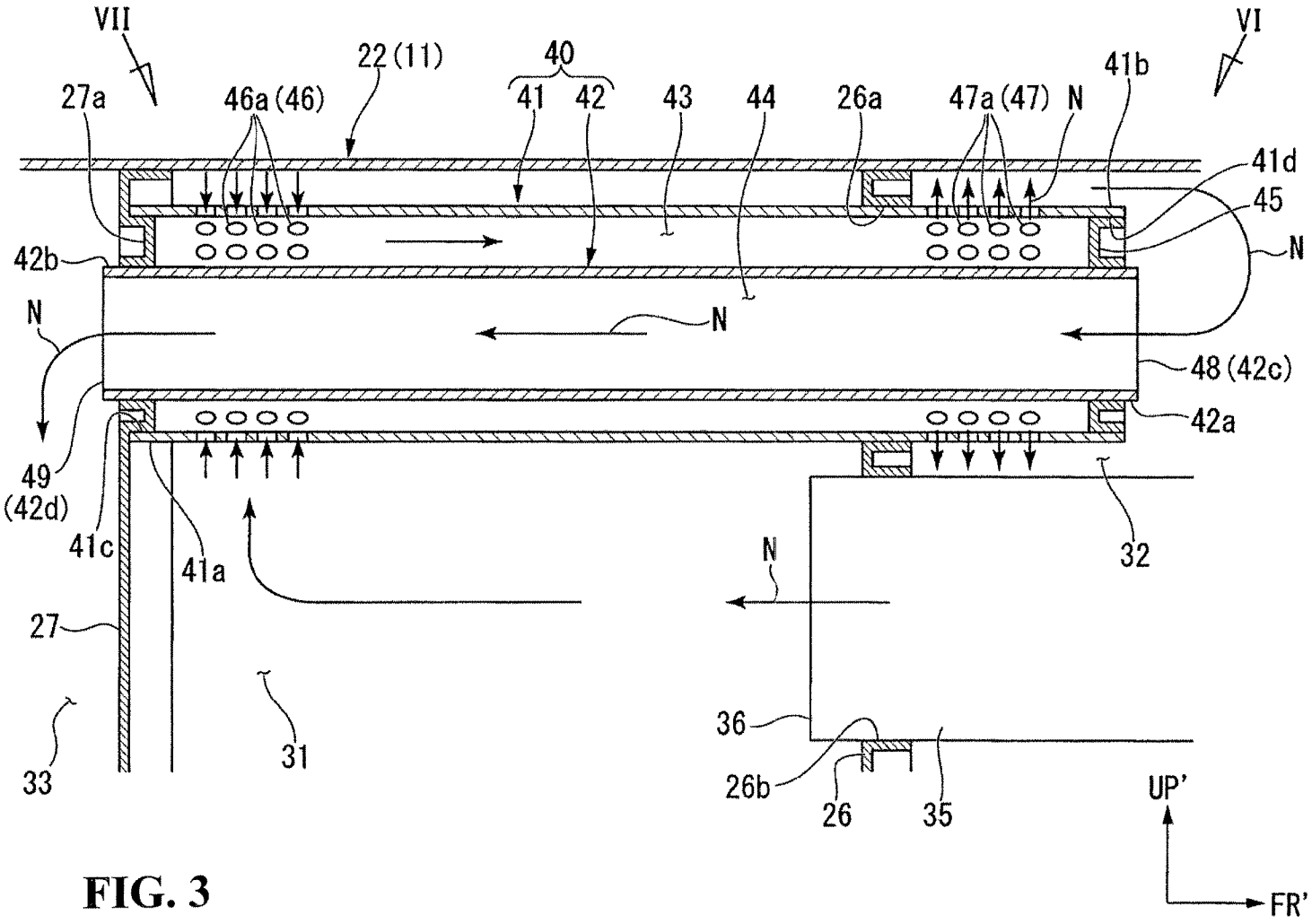
FIG. 3 is an enlarged view of an essential part of FIG. 2.
Figure 4A:
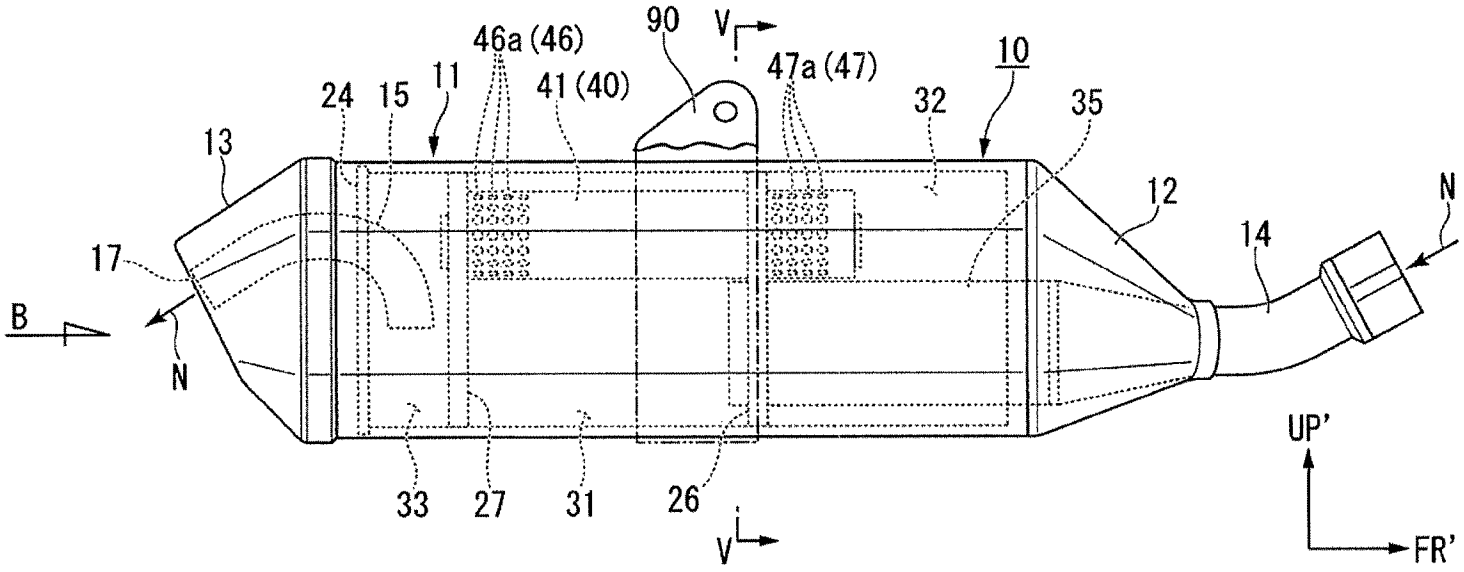
FIG. 4(*a*) is a right side view of the above exhaust muffler.
Figure 4B:
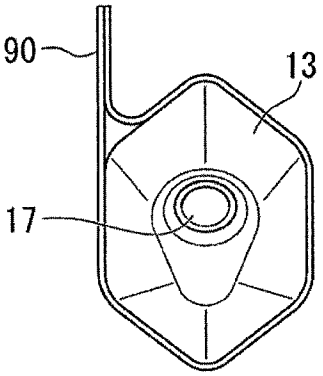

As shown in FIG. 2, the exhaust muffler 10 includes a cylinder body 11 which has a linearly extending cylindrical appearance. The cylinder body 11 has a double pipe structure consisting of an outer cylinder 21 and an inner cylinder 22 located in an inside of the outer cylinder 21. The outer cylinder 21 and the inner cylinder 22 are formed in predetermined cross sectional shapes, respectively. An annular clearance 23 is formed between an inner circumference of the outer cylinder 21 and an outer circumference of the inner cylinder 22. Into this annular clearance 23 there is filled a sound absorbing material such as glass wool or the like, for example.

To a front end of the cylinder body 11, there is connected a front cap 12 of a tapered shape which is tapered forwardly. To a rear end of the cylinder body 11, there is connected a tail cap 13 provided with a rear end surface which is downwardly inclined with respect to a rear end surface orthogonal to the axial direction of the muffler.

A rear end opening of the front cap 12 is axially aligned with a front end opening of the outer cylinder 21 of the cylinder body 11 and joined thereto by welding or the like. A front pipe 14 which is connected to the exhaust pipe 124 passes through and is supported on the front end opening of the front cap 12. An outer circumferential surface of the front pipe 14 and the front end opening of the front cap 12 are joined together by welding or the like.

On an outer circumference of an upper portion of an intermediate part of the cylinder body 11, there is provided a mounting bracket 90 for mounting the intermediate part on a vehicle body frame of the motorcycle 110. The exhaust muffler 10 is mounted on the vehicle body of the motorcycle 110 in such a manner that a front end portion of the front pipe 14 is connected to and supported on a rear end portion of the exhaust pipe 124 and an upper side of the intermediate part of the cylinder body 11 is mounted through the mounting bracket 90 on the vehicle body frame (see FIG. 1).

A front end portion of the inner cylinder 22 of the cylinder body 11 is supported on an inner portion of the outer cylinder 21 through a supporting ring 25. A front end opening of the inner cylinder 22 opens into a space within the front cap 12. A rear end portion of the inner cylinder 22 is supported on the outer cylinder 21 through an outer circumferential rib 24*a* of an end plate 24 which lies at right angles to the axial direction of the muffler.

A first partition wall 26 of a plate shape extends orthogonal to the axial direction of the muffler and is provided in a region close to a front of an intermediate part in the axial direction of the inner cylinder 22. A second partition wall 27 of a plate shape which extends orthogonal to the axial direction of the muffler is provided in a region close to a rear in the axial direction of the inner cylinder 22. In the interior of the exhaust muffler 10, a first expansion chamber 31 is defined between the first partition wall 26 and the second partition wall 27, a second expansion chamber is defined in front of the first partition wall 26, and a third expansion chamber 33 is defined between the second partition wall 27 and the end plate 24.

The front pipe 14 has a front part which is substantially the same diameter as the exhaust pipe 124 and a rear part which is formed in a rearwardly spreading taper shape. A rear end of the front pipe 14 is connected to an exhaust gas inlet tube body 35 which extends in parallel with the cylinder body 11. The exhaust gas inlet tube body 35 extends across the second expansion chamber 32 and passes through a lower part of the first partition wall 26. A rear end portion of the exhaust gas inlet tube body 35 faces into the first expansion chamber 31. An exhaust gas purifying catalyser CAT is retained in an interior of the exhaust gas inlet tube body 35. More specifically, the exhaust gas inlet tube body 35 forms a casing for the exhaust gas purifying catalyser CAT. An exhaust port 36 located in a rear end of the exhaust gas inlet tube body 35 opens rearwardly in the vicinity of a front end of the first expansion chamber 31.

A double communicating tube 40 extends in parallel with the cylinder body 11 and is supported on the first partition wall 26 and the second partition wall 27. The double communicating tube 40 is arranged directly above the exhaust gas inlet tube body 35. The double communicating tube 40 includes an outer communicating tube 41 and an inner communicating tube 42 which are arranged spaced apart from each other. The outer communicating tube 41 passes through the first partition wall 26 and provides communication between the first expansion chamber 31 and the second expansion chamber 32. The inner communicating tube 42 passes through the first partition wall 26 and the second partition wall 27 so as to provide communication between the second expansion chamber 32 and the third expansion chamber 33. An inside passage 44 in an interior of the inner communicating tube 42 and an annular passage 43 between the inner communicating tube 42 and the outer communicating tube 41 are formed as passages through which the exhaust gas flows in opposite directions.

More specifically, in the annular passage 44 within the outer communicating tube 41 which provides communication between the first expansion chamber 31 and the second expansion chamber 32, the exhaust gas flows from a rear end side to a front end side. In the inside passage 44 within the inner communicating tube 42 which provides a communication between the second expansion chamber 32 and the third expansion chamber 33, the exhaust gas flows the front end side to the rear end side. Hereinafter, a rear end portion of the outer communicating tube 41 is referred to as an intake side tube end portion 41*a*, and a front end portion of the outer communicating tube 41 is referred to as an exhaust side tube end portion 41*b*. Moreover, a front end portion of the inner communicating tube 42 is referred to as an intake side tube end portion 42*a*, and a rear end portion of the inner communicating tube 42 is referred to as an exhaust side tube end portion 42*b*. In addition, in the outer communicating tube 41, a range of a predetermined width located forwardly from the intake side tube end portion 41*a* is referred to as an intake region having a plurality of small holes (intake port) 46*a*, and a range of a predetermined width located rearwardly from the exhaust side tube end portion 41*b* is referred to as an exhaust region having a plurality of small holes (exhaust port) 47*a*.

A front part of the outer communicating tube 41 passes through the first partition wall 26, and the exhaust region is arranged within the second expansion chamber 32. The front part of the outer communicating tube 41 is supported on the first partition wall 26 while passing through it.

Figure 5:
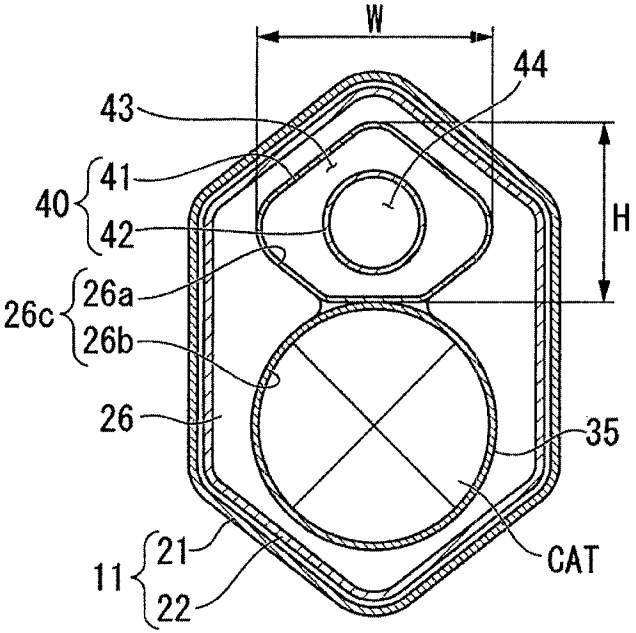
FIG. 5 is a cross sectional view taken on line V-V of FIG. 4(*a*)

As shown in FIG. 5, the first partition wall 26 has an upper supporting hole 26*a* on which the outer communicating tube 41 and a front part of the double communicating tube 40 are supported while passing therethrough, and a lower supporting hole 26*b* on which a rear end portion of the exhaust gas inlet tube body 35 is supported while passing therethrough. These two supporting holes 26*a*, 26*b* are formed as a continuously connected opening 26*c* so as to make the distance between the double communicating tube 40 on the upper side and the exhaust gas inlet tube body 35 on the lower side as small as possible. With this construction, the exhaust muffler 10 is made small in size in the height direction.

The exhaust gas inlet tube body 35 has a circular shape in cross section. On the other hand, the outer communicating tube 41 of the double communicating tube 40 has a flat substantially pentagonal shape in cross section of which a vertical width is reduced. The cross sectional shape of the outer communicating tube 41 has a height dimension H in the vertical direction which is smaller than a width dimension W in the horizontal direction. Also in this point, the exhaust muffler is made small in size in the height direction. The width dimension W in the horizontal direction of the cross sectional shape of the outer communicating tube 41 is set to be not more than a width dimension (diameter) in the horizontal direction of the cross sectional shape of the exhaust gas inlet tube body 35 located below the outer communicating tube 41, whereby to prevent the exhaust muffler 10 from being increased in size in the horizontal direction.

The inner communicating tube 42 having a circular cross sectional shape is inserted into the outer communicating tube 41 of the above cross sectional shape so that the annular passage 43 is formed between the inner communicating tube 42 and the outer communicating tub 41. A width of the annular passage 43 in the radial direction orthogonal to the axial direction of the annular passage 43 varies in accordance with positions in the circumferential direction of the annular passage 43. Therefore, the annular passage 43 is formed with a narrow region in the radial direction (upper and lower regions on the outside of the inner communicating tube 42) and a wide region in the radial direction (left and right regions on the outside of the inner communicating tube 42).

Figure 6:
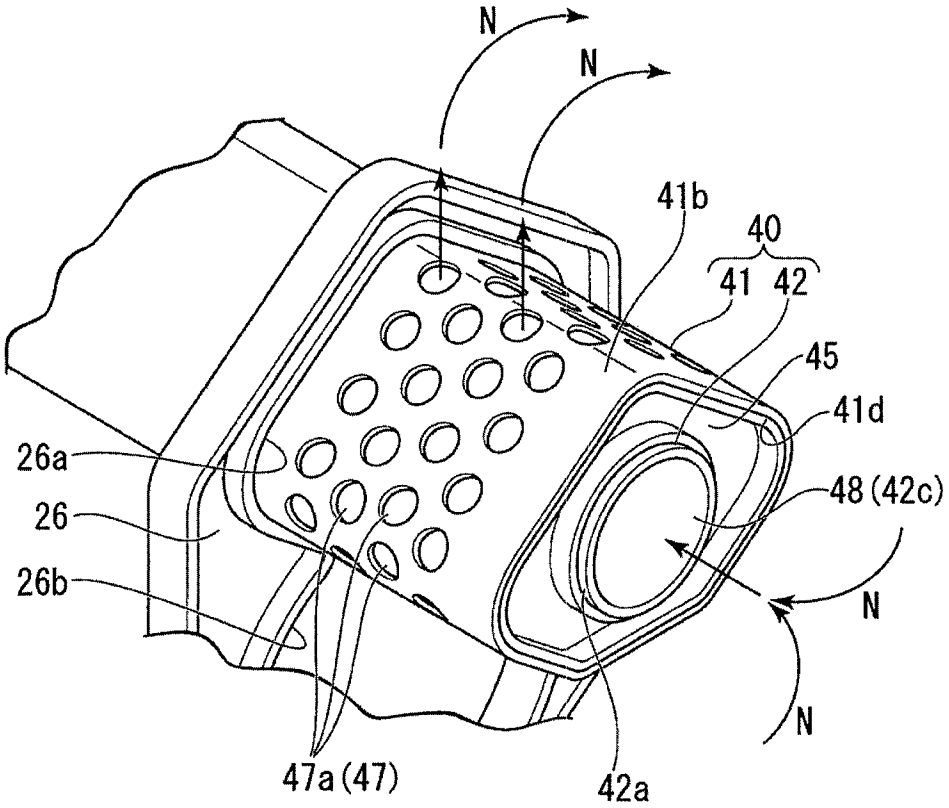
FIG. 6 is a perspective view of a part VI of FIG. 3.

As shown in FIGS. 2 and 6, in the intake side tube end portion 42*a* of the inner communicating tube 42, an intake port 48 is formed by a distal end opening 42*c* of the inner communicating tube 42.

Figure 7:
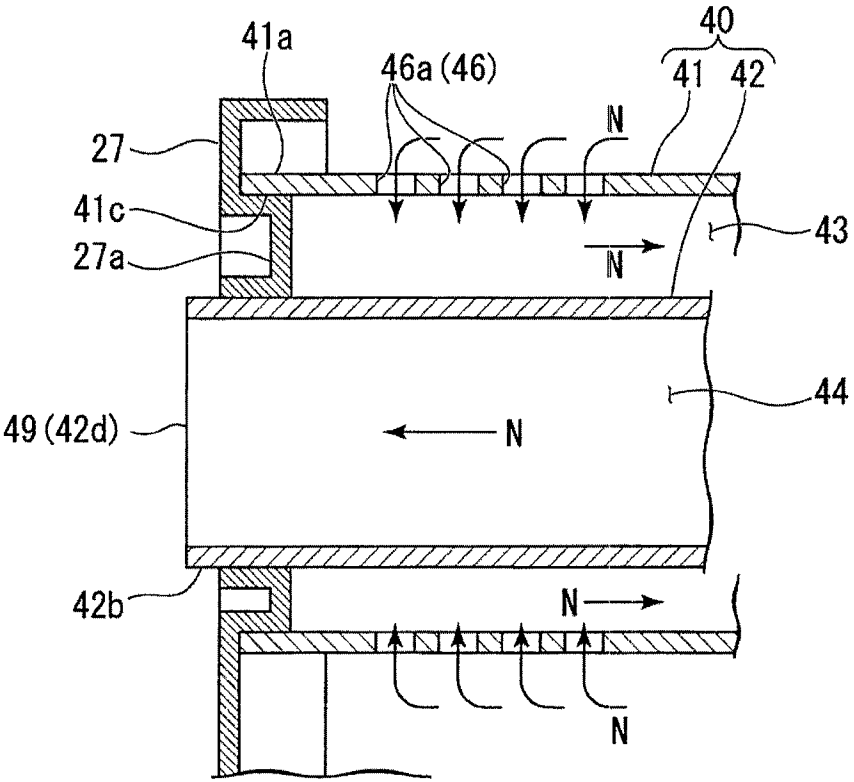
FIG. 7 is an enlarged view of a part VII of FIG. 3.

As shown in FIGS. 2 and 7, in the exhaust side tube end portion 42*b* of the inner communicating tube 42, an exhaust port 49 is formed by a distal end opening 42*d* of the inner communicating tube 42.

On the other hand, a distal end opening 41*d* of the exhaust side tube end portion 41*b* of the outer communicating tube 41 is closed with a closing member 45 into which the intake side tube end portion 42*a* of the inner communicating tube 42 is inserted so as to be supported by the closing member 45. An exhaust port 47 on the distal end side of the outer communicating tube 41 is formed by a plurality of small holes 47*a* which open radially outwardly in the exhaust region. Although the closing member 45 may be arranged in a more recessed side (side closer to the first partition wall 26) than the distal end opening 41 d, it is preferable that it is arranged closer to the distal end opening 41 d than the first partition wall 26 so as to ensure the length of the annular passage 43 and to ensure the exhaust region.

The exhaust region is arranged closer to the first partition wall 26 than the closing member 45. The intake side tube end portion 42*a* of the inner communicating tube 42 is located in the vicinity of the distal end opening 41*d* of the exhaust side tube end portion 41*b* of the outer communicating tube 41 closed with the closing member 45. More precisely, the intake side tube end portion 42*a* of the inner communicating tube 42 is arranged in such a way as to project a little forwardly from the distal end opening 41*d* of the exhaust side tube end portion 41*b* of the outer communicating tube 41. More specifically, the exhaust region is arranged spaced apart from the intake side tube end portion 42*a* of the inner communicating tube 42 as far as possible. The intake side tube end portion 42*a* of the inner communicating tube 42 is supported on an inner circumference of the exhaust side tube end portion 41*b* of the outer communicating tube 41 through the closing member 45.

Further, the intake side tube end portion 41*a* of the outer communicating tube 41 is closed with a second closing portion 27*a* of the second partition wall 27 into which the exhaust side tube end portion 42*b* of the inner communicating tube 42 is inserted so as to be supported by the second closing portion 27*a*. The second closing portion 27*a* is formed in the shape of an annular projection which projects forwardly around the circumference of a passing-through portion of the inner communicating tube 42. A distal end opening 41*c* of the intake side tube end portion 41*a* of the outer communicating tube 41 is fitted onto and butted against an outer circumference of the second closing portion 27*a* from the front side. With this construction, the position in the forward and rearward direction of the outer communicating tube 41 is fixed, and the intake side tube end portion 41*a* is supported on the second partition wall 27 in a closing state. An intake port 46 on the rear end side of the outer communicating tube 41 is formed with the plurality of small holes 46*a* which open radially outwardly in the intake region. The intake region is arranged close to the second partition wall 27 so as to ensure the length of the annular passage 43.

The exhaust side tube end portion 42*b* of the inner communicating tube 42 is arranged in such a way as to project a little rearwardly from the distal end opening 41*c* of the intake side tube end portion 41*a* of the outer communicating tube 41 and the second partition wall 27. The exhaust side tube end portion 42*b* of the inner communicating tube 42 is supported on an inner circumference of the second closing portion 27*a* of the second partition wall 27.

As shown in FIG. 2, the exhaust port 49 of the inner communicating tube 42 faces and opens into an upper part of the third expansion chamber 33. A tail pipe 15 of an upwardly convexed curve shape is inserted into and supported on an upper part of the end plate 24. The tail pipe 15 has a front end opening which opens downwardly. The front end opening of the tail pipe 15 functions as an intake port 16 and is arranged below the exhaust port 49 of the inner communicating tube 42 within the third expansion chamber 33. The intake port 16 of the tail pipe 15 is arranged spaced apart from the exhaust port 49 of the inner communicating tube 42, so that the volume of the third expansion chamber 33 is effectively utilized to thereby heighten the noise reduction effect.

The tail pipe 15 has a rear end opening which opens downwardly to the rear. The rear end opening of the tail pipe 15 opens in the outward direction of the muffler so as to function as an exhaust port 17 of the whole of the exhaust muffler 10. In addition, by dispensing with the end plate 24, the tail pipe 15 and the third expansion chamber 33, the exhaust port 49 of the inner communicating tube 42 may be used as an exhaust port of the whole of the exhaust muffler 10 in such a way as to open in the outward direction of the muffler.

First, the exhaust gas introduced into the front pipe 14 from the exhaust pipe 124 is purified by the exhaust gas purifying catalyser CAT within the exhaust gas inlet tube body 35 and then, passes through in the order of the first expansion chamber 31, the second expansion chamber 32 and the third expansion chamber 33 while flowing in such a way as to turn around within the cylinder body 11, so that it is cooled down and reduced in pressure so as to lower or reduce the exhaust heat and the exhaust noise. Thereafter, the exhaust gas is discharged from the exhaust port 17 of the tail pipe 15.

The exhaust gas flowing into the first expansion chamber 31 from the exhaust gas inlet tube body 35 is expanded and reduced in pressure within the first expansion chamber, and thereafter, flows into the annular passage 43 from the intake port 46 of the outer communicating tube 41 located on the rear end side of the double communicating tube 40. The exhaust gas within the annular passage 43 then flows forwardly along the annular passage 43, and then, flows outwardly in the radial direction (not rearwardly in the axial direction) into the second expansion chamber 32 from the exhaust port 47 of the outer communicating tube 41 located on the front end side of the double communicating tube 40.

At that time, the exhaust gas flows outwardly in the radial direction from the exhaust port 47 of the outer communicating tube 41, so that it goes away from the intake port 48 of the inner communicating tube 42 within the second expansion chamber 32. Therefore, the exhaust gas flowing out of the exhaust port 47 is restrained from flowing immediately into the intake port 48 without being expanded sufficiently within the second expansion chamber 32, whereby the volume of the second expansion chamber 32 is effectively utilized and the noise reduction is efficiently performed. Since the exhaust gas is dispersed by a group of the multiple small holes 47*a* formed as the exhaust port 47 of the outer communicating tube 41 and flows into the second expansion chamber 32, the noise reduction effect is still more heightened.

As described above, in the exhaust muffler 10 of the above embodiment, on the front end side of the double communicating tube 40 facing into the second expansion chamber 32, the distal end opening 42*c* of the inner communicating tube 42 is formed as the intake port 48 of the inside passage 44. In (or in the vicinity of) the distal end opening 41*d* of the outer communicating tube 41, there is provided the closing member 45 for closing the end in the axial direction of the annular passage 43. Between the closing member 45 of the outer communicating tube 41 and the first partition wall 26, there is provided the exhaust port 47 for opening the annular passage 43 outwardly in the radial direction.

With this construction, since, on the front end side of the double communicating tube 40 facing into the second expansion chamber 32, the intake port 48 of the inner communicating tube 42 is directed toward the axial direction, and the exhaust port 47 of the outer communicating tube 41 is directed outwardly in the radial direction, the exhaust gas flowing out of the exhaust port 47 of the outer communicating tube 41 can flow in such a way so as to take a long way around the intake port 48 of the inner communicating tube 42 to thereby be expanded. At the same time, the exhaust gas flowing out of the exhaust port 47 of the outer communicating tube 41 can be restrained from flowing directly into the intake port 48 of the inner communicating tube 42 in comparison with the case where the exhaust port 47 of the outer communicating tube 41 is directed toward the axial direction similar to the intake port 48 of the inner communicating tube 42, so that it can be expanded sufficiently within the expansion chamber 32. More specifically, the volume of the second expansion chamber 32 is utilized sufficiently whereby to be able to effectively perform the noise reduction. Further, since the double communicating tube 40 combining two communicating tubes is provided, the arrangement space for the communicating tubes can be reduced whereby to make it possible to increase the degree of freedom in arrangement of the communicating tubes, in comparison with the case where two communicating tubes are arranged spaced apart from each other in a side by side relationship.

Further, in the above exhaust muffler 10, the closing member 45 is formed in a plate shape which intersects with the axial direction of the double communicating tube 40, and arranged closer to the distal end opening 41*d* of the outer communicating tube 41 than the first partition wall 26. Therefore, in comparison with the case where the closing member 45 terminating the annular passage 43 is located in the vicinity of the first partition wall 26, the length of the outer communicating tube 41 can be effectively utilized so that the length of the annular passage 43 can be ensured and the range for providing the exhaust port 47 of the outer communicating tube 41 can be ensured.

In the above exhaust muffler 10, since the exhaust port 47 of the outer communicating tube 41 is arranged in such a way so as to be offset toward the first partition wall 26 between the first partition wall 26 and the closing member 45, the exhaust port 47 and the distal end opening 42*c* of the inner communicating tube 42 are spaced apart from each other as far as possible, so that the exhaust gas flowing out of the exhaust port 47 of the outer communicating tube 41 can be more effectively restrained from flowing directly into the intake port 48 of the inner communicating tube 42.

In the above exhaust muffler 10, on the rear end side of the double communicating tube 40 facing into the first expansion chamber 31 partitioned from the second expansion chamber 32 by the first partition wall 26, the end portion of the outer communicating tube 41 is supported on second partition wall 27 located on the opposite side of the first expansion chamber 31 from the first partition wall 26. With this construction, the number of component parts is reduced and the outer communicating tube 41 can be supported at both ends. Therefore, the support of the outer communicating tube 41 can be stabilized as compared with the cantilever support of the outer communicating tube 41, and the positioning and assembly of the outer communicating tube 41 can be easily performed. In addition, the outer communicating tube 41 can be extended long whereby to heighten a noise reduction effect.

In the above exhaust muffler 10, the second closing portion 27*a* which closes the distal end opening 41 c of the outer communicating tube 41 located on the second partition wall 27 side is formed in the second partition wall 27, and the intake port 46 which opens the annular passage 43 outwardly in the radial direction is provided in the end portion of the outer communicating tube 41 located on the second partition wall 27 side. With this construction, since the other end side of the outer communicating tube 41 is closed while being supported, and the exhaust gas flows in such a way so as to spread within the first expansion chamber 31, the volume of the other expansion chamber also can be utilized sufficiently, so that the noise reduction can be effectively performed.

In the above exhaust muffler 10, since the end portion of the inner communicating tube 42 located on the second partition wall 27 side is supported on the second partition wall 27, and the end of the inner communicating tube 42 located on the first partition wall 26 side is supported through the closing member 45 on the outer communicating tube 41, the number of component parts can be reduced and the inner communicating tube 42 can be supported at both ends. Therefore, the support and assembly of the inner communicating tube 42 can be stabilized as compared with the cantilever support, and the inner communicating tube 42 can be extended long whereby to heighten the noise reduction effect.

In the above exhaust muffler 10, the exhaust gas inlet tube body 35 which passes through the first partition wall 26 is arranged below the double communicating tube 40. The double communicating tube 40 has the inner communicating tube 42 of a circular cross section and the outer communicating tube 41 of a non-circular cross section, and the outer communicating tube 41 has a cross sectional shape of which the height dimension H in a vertical direction is smaller than the width dimension W in a horizontal direction. With this construction, the double communicating tube 40 and the exhaust gas inlet tube body 35 are vertically arranged in a side by side relationship, so that the width in the horizontal direction of the exhaust muffler 10 can be reduced and the height in the vertical direction of the exhaust muffler 10 can be reduced as much as possible. In addition, although the thickness in the radial direction of the annular passage 43 varies in accordance with the positions in the circumferential direction due to the inner communicating tube 42 of circular cross section and the outer communicating tube 41 of non-circular cross section, the passage area can be ensured while reducing the height of the exhaust muffler as much as possible by reducing the thicknesses of both side parts in the height direction of the annular passage 43 and increasing the thicknesses of both side parts in the width direction thereof.

In addition, in comparison with the case where the thickness in the radial direction of the annular passage 43 is constant, the thickness in the radial direction of the annular passage 43 increases or decreases locally in accordance with the positions in the circumferential direction. Therefore, the pressure loss of the exhaust gas becomes smaller in the part in which the thickness in the radial direction of the annular passage 43 increases, so that a good exhaust gas flow of the whole annular passage 43 can be obtained.

The present invention is not limited to the above described embodiment. For example, on one end side of the double communicating tube 40 facing into one of the expansion chambers, the distal end opening 42*c* of the inner communicating tube 42 may be formed as an exhaust port, and the outer circumferential opening of the outer communicating tube 41 may be formed as an intake port. Moreover, the closing portion for closing the end in the axial direction of the annular passage 43 is not limited to the separate closing member 45 but may be configured to close the annular passage 43 by joining the end of the outer communicating tube 41 to the inner communicating tube 42 by squeezing the end of the outer communicating tube 41, for example. In addition, the outer circumferential opening of the outer communicating tube 41 is not limited to punching holes but may be formed in a slit shape or a net shape.

Further, the outer communicating tube 41 may be configured to be supported only by the first partition wall 26 in a cantilever fashion such that the outer communicating tube 41 terminates at a position forwardly of the second partition wall 27 so as not to be supported by the second partition wall 27. In this case, the outer circumferential opening of the outer communicating tube 41 located in the end part of the second partition wall 27 is dispensed with, and the distal end opening 41*c* of the outer communicating tube 41 is used as the intake port of the annular passage 43.

In addition, the exhaust muffler of the present invention is not limited to the exhaust muffler for the two-wheeled motorcycle, but may be applied to the exhaust muffler for a three-wheeled vehicle (the vehicle having one front wheel and two rear wheels or two front wheels and one rear wheel) or a four-wheeled vehicle.

It should be understood that the construction in the above embodiment is to be taken as an example of the present invention and that various changes and modifications may be made in the invention without departing from the spirit and scope thereof The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust muffler comprising:

a cylindrical body;

a partition wall which partitions an interior of the cylindrical body into a plurality of expansion chambers; and a communicating tube passing through the partition wall, wherein the communicating tube is in the form of a double communicating tube formed of an outer communicating tube and an inner communicating tube, and an inside passage disposed within the inner communicating passage and an annular passage disposed between the inner communicating tube and the outer communicating tube which functions as an exhaust passage through which exhaust gases flow in opposite directions to each other;

wherein one end side of the double communicating tube faces into one of the expansion chambers with a distal end opening of the inner communicating tube functioning as an intake and exhaust port of the inside passage; and wherein a closing member is provided for closing an end, in the axial direction, of the annular passage in or in the vicinity of a distal end opening of the outer communicating tube, and an outer circumferential intake and exhaust port, which communicates with one of the expansion chambers, for opening the annular passage outwardly in a radial direction, is provided between the closing portion of the outer communicating tube and the partition wall.

2. The exhaust muffler according to claim 1, wherein on the one end side of the double communicating tube, the distal end opening of the inner communicating tube functions as an intake port, and the outer circumferential intake and exhaust port functions as an exhaust port which is close to the inner cylinder of the cylinder body and opens toward the inner cylinder.

3. The exhaust muffler according to claim 1, wherein the closing portion is provided with a closing member of a plate shape for intersecting with an axial direction of the double communicating tube, and the closing member is arranged closer to the distal end opening of the outer communicating tube than the partition wall, wherein the outer communicating tube has a second intake and exhaust ort that communicates with another expansion chamber, such that the exhaust port and the distal end opening of the inner communicating tube are oriented in different directions.

4. The exhaust muffler according to claim 2, wherein the closing portion is provided with a closing member of a plate shape for intersecting with an axial direction of the double communicating tube, and the closing member is arranged closer to the distal end opening of the outer communicating tube than the partition wall.

5. The exhaust muffler according to claim 1, wherein the outer circumferential intake and exhaust port are arranged to be offset toward the partition wall between the closing portion and the partition wall.

6. The exhaust muffler according to claim 2, wherein the outer circumferential intake and exhaust port are arranged to be offset toward the partition wall between the closing portion and the partition wall.

7. The exhaust muffler according to claim 3, wherein the outer circumferential intake and exhaust port are arranged to be offset toward the partition wall between the closing portion and the partition wall.

8. The exhaust muffler according to claim 1, wherein on the other end side of the double communicating tube facing into the other expansion chamber partitioned from the one expansion chamber by the partition wall, an end portion of the outer communicating tube is supported on an opposed wall located on the opposite side of the other expansion chamber from the partition wall.

9. The exhaust muffler according to claim 2, wherein on the other end side of the double communicating tube facing into the other expansion chamber partitioned from the one expansion chamber by the partition wall, an end portion of the outer communicating tube is supported on an opposed wall located on the opposite side of the other expansion chamber from the partition wall.

10. The exhaust muffler according to claim 8, and further comprising a second closing portion closing the distal end opening of the outer communicating tube located on the opposed wall side, and a second outer circumferential intake and exhaust port for opening the annular passage outwardly in the radial direction, wherein the second closing portion is formed in the opposed wall, and the second outer circumferential intake and exhaust port is provided in the end portion of the outer communicating tube located on the opposed wall side.

11. The exhaust muffler according to claim 8, wherein an end portion of the inner communicating tube located on the opposed wall side is supported on the opposed wall, and an end of the inner communicating tube located on the partition wall side is supported through the closing portion on the outer communicating tube.

12. The exhaust muffler according to claim 10, wherein an end portion of the inner communicating tube located on the opposed wall side is supported on the opposed wall, and an end of the inner communicating tube located on the partition wall side is supported through the closing portion on the outer communicating tube.

13. The exhaust muffler according to claim 1, and further comprising another tube which passes through the partition wall and is arranged below the double communicating tube, wherein the double communicating tube has the inner communicating tube of a circular cross section and the outer communicating tube of a non-circular cross section, and the outer communicating tube has a cross sectional shape of which a height dimension in a vertical direction is smaller than a width dimension in a horizontal direction.

14. The exhaust muffler according to claim 2, and further comprising another tube which passes through the partition wall and is arranged below the double communicating tube, wherein the double communicating tube has the inner communicating tube of a circular cross section and the outer communicating tube of a non-circular cross section, and the outer communicating tube has a cross sectional shape of which a height dimension in a vertical direction is smaller than a width dimension in a horizontal direction.

15. An exhaust muffler comprising:

a body;

a partition wall which partitions an interior of the body into a plurality of expansion chambers; and an outer communicating tube and an inner communicating tube passing through the partition wall wherein an inside passage within the inner communicating passage and an annular passage between the inner communicating tube and the outer communicating tube function as exhaust passages through which exhaust gases flow in opposite directions to each other;

one end side of the double communicating tube faces one of the expansion chambers with a distal end opening of the inner communicating tube functioning as an intake and exhaust port of the inside passage; and a closing portion for closing an end in the axial direction of the annular passage, said closing portion being provided in or in the vicinity of a distal end opening of the outer communicating tube, and outer circumferential intake and exhaust ports for opening the annular passage outwardly, in a radial direction, are provided between the closing portion of the outer communicating tube and the partition wall.

16. The exhaust muffler according to claim 15, wherein on the one end side of the outer and inner communicating tube, the distal end opening of the inner communicating tube functions as an intake port, and the outer circumferential intake and exhaust port functions as an exhaust port.

17. The exhaust muffler according to claim 15, wherein the closing portion is provided with a closing member of a plate shape for intersecting with an axial direction of the double communicating tube, and the closing member is arranged closer to the distal end opening of the outer communicating tube than the partition wall.

18. The exhaust muffler according to claim 15, wherein the outer circumferential intake and exhaust port are arranged to be offset toward the partition wall between the closing portion and the partition wall.

19. The exhaust muffler according to claim 15, wherein on the other end side of the outer and inner communicating tube facing into the other expansion chamber partitioned from the one expansion chamber by the partition wall, an end portion of the outer communicating tube is supported on an opposed wall located on the opposite side of the other expansion chamber from the partition wall.

20. The exhaust muffler according to claim 19, and further comprising a second closing portion closing the distal end opening of the outer communicating tube located on the opposed wall side, and a second outer circumferential intake and exhaust port for opening the annular passage outwardly in the radial direction, wherein the second closing portion is formed in the opposed wall, and the second outer circumferential intake and exhaust port is provided in the end portion of the outer communicating tube located on the opposed wall side.

21. An exhaust muffler which comprises:

a cylindrical body, an exhaust gas inlet tube having an outlet which extends into the proximal end portion of the cylindrical body, a double communication tube having an inlet disposed in contiguous juxtaposition with the outlet of the exhaust gas inlet tube, said double communication tube comprising an outer communication tube coaxially surrounding an inner communication tube and defining an inner passage within the inner communication tube and an annular passage disposed between the outer and inner communication tube, a first expansion chamber disposed at the outlet of the exhaust gas inlet tube, a second expansion chamber disposed at the inlet to the inner communication tube, apertures provided in a wall of the outer communication tube to provide outward, radial communication between the first expansion chamber and the second expansion chamber through said annular passage, and a third expansion chamber disposed at the distal portion of the cylindrical body with the outlet of the inner passage of the double communication tube communicating with the third expansion chamber, whereby the flow of exhaust gas is controlled by the sequential communication between the first, second and third expansion chambers so that the volumes of the expansion chambers are effectively utilized in performing noise reduction.

22. The exhaust muffler of claim 21, wherein the exhaust gas inlet tube and the double communication tube are positioned within the cylindrical body to channel the exhaust gas from the exhaust gas inlet tube into the first expansion chamber, through the annular passage of the double communication tube, in an opposite direction, into the second expansion chamber, and again, in a reversed, opposite direction into the third expansion chamber, from where it is expelled from the exhaust muffler.

23. The exhaust muffler of claim 21, wherein the double communication tube has a proximal end portion positioned near the exhaust gas inlet tube and a distal end portion positioned near the third expansion chamber, wherein the apertures provided in the wall of the outer communication tube enable radial communication into the annular passage of the double communication tube, and the exhaust gas exits from the annular passage into the second expansion chamber, where the direction of flow of the exhaust gas is reversed to flow into the inner communication tube, from where it exits into the third expansion chamber at said distal end portion.

* * * * *